US005795644A

United States Patent [19]

Delarosa

[11] Patent Number: 5,795,644

[45] Date of Patent: Aug. 18, 1998

[54] SCENTED BUBBLE WRAP

[76] Inventor: Joseph C Delarosa, 2010 S. Palo Verde, Tucson, Ariz. 85713

[21] Appl. No.: 806,255

[22] Filed: Feb. 21, 1997

[51] Int. Cl.[6] ..... B32B 1/00

[52] U.S. Cl. ..... 428/178; 428/905

[58] Field of Search ..... 428/178, 72, 402.2, 428/905; 493/967; 206/522, 814; 239/56

[56] References Cited

U.S. PATENT DOCUMENTS 5,391,420 2/1995 Bootman et al. ..... 428/195

*Primary Examiner*—Donald Loney

[57] ABSTRACT

A new Scented Bubble Wrap for providing a means to protect delicate gifts while emitting a pleasant scent. The inventive device includes generally, a sheet of polyethylene comprising a multiplicity of individual closed cell compartments containing a scented fluid.

11 Claims, 2 Drawing Sheets

FIG. 3
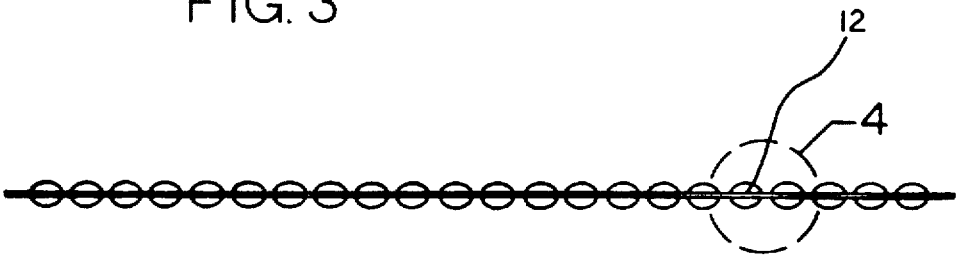
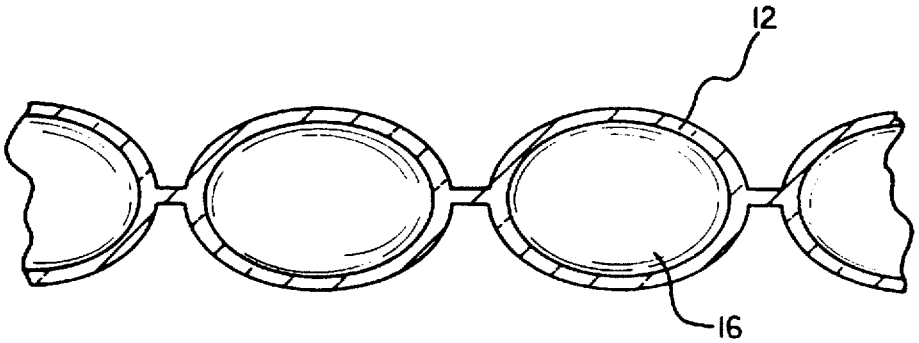
FIG. 4

SCENTED BUBBLE WRAP

BACKGROUND OF THE INVENTION

1. Field of the Invention

The present invention relates to scented wrapping devices and more particularly pertains to a new Scented Bubble Wrap for providing a means to protect delicate gifts while emitting a pleasant scent.

2. Description of the Prior Art

The use of scented wrapping devices is known in the prior art. More specifically, scented wrapping devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art scented wrapping devices include U.S. Pat. No. 5,273,361; U.S. Pat. No. 4,112,599; U.S. Pat. No. 5,220,636; U.S. Pat. No. 4,869,407; U.S. Pat. No. 4,875,912 and U.S. Pat. No. 351,934.

While these devices fulfill their respective, particular objectives and requirements, the aforementioned patents do not disclose a new Scented Bubble Wrap. The inventive device includes generally, a sheet of polyethylene comprising a multiplicity of individual closed cell compartments containing a scented fluid.

In these respects, the Scented Bubble Wrap according to the present invention substantially departs from the conventional concepts and designs of the prior art, and in so doing provides an apparatus primarily developed for the purpose of providing a means to protect delicate gifts while emitting a pleasant scent.

SUMMARY OF THE INVENTION

In view of the foregoing disadvantages inherent in the known types of scented wrapping devices now present in the prior art, the present invention provides a new Scented Bubble Wrap construction wherein the same can be utilized for providing a means to protect delicate gifts while emitting a pleasant scent.

The general purpose of the present invention, which will be described subsequently in greater detail, is to provide a new Scented Bubble Wrap apparatus and method which has many of the advantages of the scented wrapping devices mentioned heretofore and many novel features that result in a new Scented Bubble Wrap which is not anticipated, rendered obvious, suggested, or even implied by any of the prior art scented wrapping devices, either alone or in any combination thereof.

To attain this, the present invention generally comprises generally, a sheet of polyethylene comprising a multiplicity of individual closed cell compartments containing a scented fluid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Scented Bubble Wrap apparatus and method which has many of the advantages of the scented wrapping devices mentioned heretofore and many novel features that result in a new Scented Bubble Wrap which is not anticipated, rendered obvious, suggested, or even implied by any of the prior art scented wrapping devices, either alone or in any combination thereof.

It is another object of the present invention to provide a new Scented Bubble Wrap which may be easily and efficiently manufactured and marketed.

It is a further object of the present invention to provide a new An even further object of the present invention is to provide a new Scented Bubble Wrap which is susceptible of a low cost of manufacture with regard to both materials and labor, and which accordingly is then susceptible of low prices of sale to the consuming public, thereby making such Scented Bubble Wrap economically available to the buying public.

Still yet another object of the present invention is to provide a new Scented Bubble Wrap which provides in the apparatuses and methods of the prior art some of the advantages thereof, while simultaneously overcoming some of the disadvantages normally associated therewith.

Still another object of the present invention is to provide a new Scented Bubble Wrap for providing a means to protect delicate gifts while emitting a pleasant scent.

Yet another object of the present invention is to provide a new Scented Bubble Wrap which includes generally, a sheet of polyethylene comprising a multiplicity of individual closed cell compartments containing a scented fluid.

Still yet another object of the present invention is to provide a new Scented Bubble Wrap that can be manufactured in a variety of colors and scents to the purchasing public.

Even still another object of the present invention is to provide a new Scented Bubble Wrap that allows users to choose wrappers that have fragrances which coincide with the particular holiday.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is an expanded view of section 4 of FIG. 3.

DESCRIPTION OF THE PREFERRED EMBODIMENT

Figure 1:
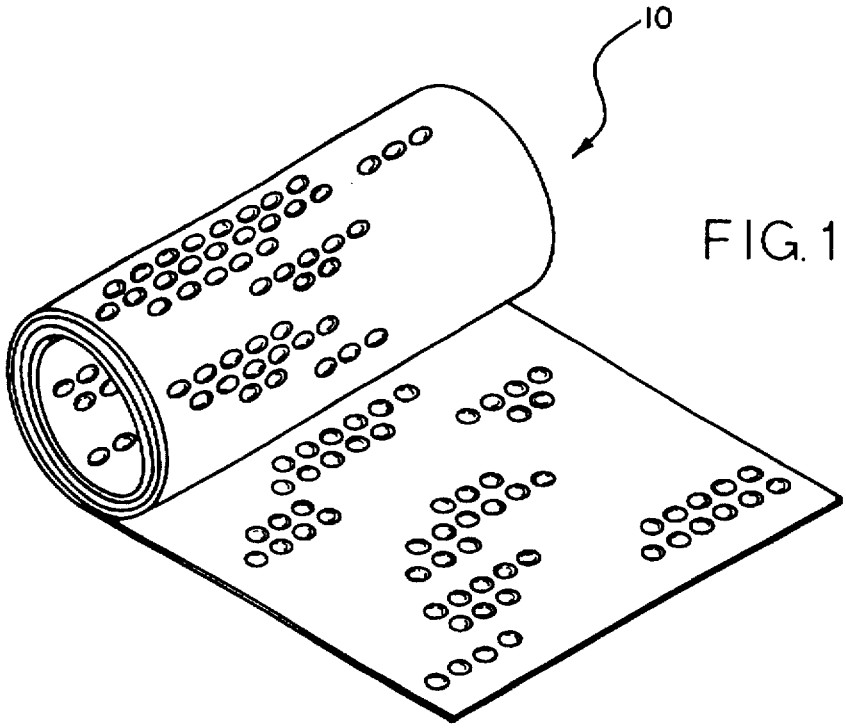
FIG. 1 is a side perspective view of a new Scented Bubble Wrap according to the present invention.
Figure 2:
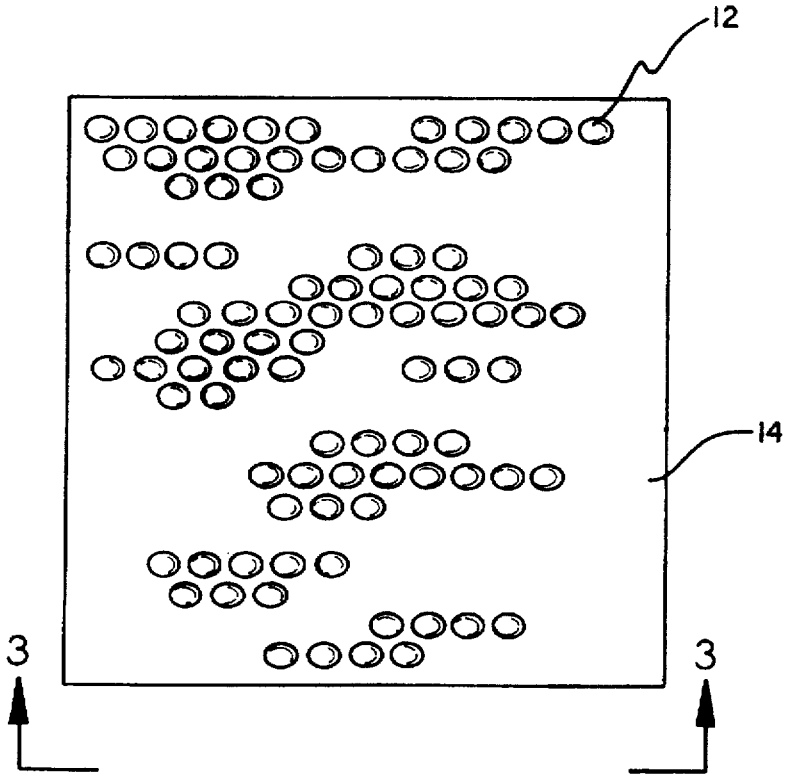
FIG. 2 is a top view thereof.

With reference now to the drawings, and in particular to FIGS. 1 through 4 thereof, a new Scented Bubble Wrap embodying the principles and concepts of the present invention and generally designated by the reference numeral 10 will be described.

More specifically, it will be noted that the Scented Bubble Wrap 10 comprises generally, a sheet of polyethylene comprising a multiplicity of individual closed cell compartments containing a scented fluid.

As best illustrated in FIGS. 1 through 4, it can be shown that the present invention teaches a novel nonobvious Scented Bubble Wrap that finds a need in the industry.

The present invention includes generally, A Scented Bubble Wrap 10 which includes a sheet of polyethylene film 14 which includes a multiplicity of individual closed cell compartments 12 containing a scented fluid 16. The polyethylene film 14 can be any variety of colors. These colors include but are not limited to green, blue, aqua, red, yellow and so forth. The film can be any suitable thickness, however, in the preferred embodiment, the film measures about 0015 inch thick.

The closed cells 12 are cylindrical shaped. In fact the technology of cylindrical closed cell bubbles are described in U.S. Pat. No. 5,273,361 and U.S. Pat. No. 4,112,599 incorporated herein by reference. The closed cells of the present invention comprises an amount of scented fluid sufficient to coat the inside of the closed cells.

The fluid could be any typical gel in the industry. Gel forming materials generally include but are not limited to materials such as tragacanth, guar gums, xanthan, karaya and so forth. These materials can be formulated with the oils of various fragrances to produce a suitable gel. Although a gel is the preferred fluid of the present invention, any other fluid of lower or higher viscosity can be used in the present invention in an effective amount. A suitable amount of fluid can be about 0.01–0.1 ounce of material.

The scents used in the present invention can be any fragrance available. Examples of typical smell include evergreen, pine, bayberry, cherry, vanilla cinnamon and almond. Typically smells can represent various times or holidays in the year. For example, Christmas smell could include evergreen, pine, or bayberry and Valentine's Day could feature a cinnamon, cherry or vanilla.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A scented bubble wrap comprising: a sheet of polyethylene comprising a multiplicity of individual closed cell compartments, said cell compartments being substantially spherical, said cell compartments containing an amount of a scented fluid.

2. The scented bubble wrap of claim 1, wherein the amount of scented fluid is sufficient to coat an inside of one of the cell compartments, and the scented fluid comprises a scented gel.

3. The scented bubble wrap of claim 1, wherein the amount of scented fluid is at least about 0.01 ounces.

4. The scented bubble wrap of claim 1, wherein the scented fluid emits a scent chosen from the group of scents consisting of evergreen, pine, bayberry, cherry, vanilla, cinnamon and almond.

5. A scented bubble wrap comprising:

a sheet of polyethylene comprising a multiplicity of individual closed cell compartments, said cell compartments being substantially spherical, said cell compartments containing an amount of a scented fluid;

wherein the amount of scented fluid is sufficient to coat an inside of one of the cell compartments, and the scented fluid comprises a scented gel;

wherein the amount of scented fluid is at least about 0.01 ounces; and wherein the scented fluid emits a scent chosen from the group of scents consisting of evergreen, pine, bayberry, cherry, vanilla, cinnamon and almond.

6. A scented bubble wrap for wrapping around an object, the scented bubble wrap comprising:

a substantially planar flexible sheet;

a plurality of enclosed substantially spherical cells within said sheet, each of said spherical cells having a central longitudinal axis coplanar with said sheet;

wherein said sheet is formed of an elastic material; and a number of said spherical cells containing an amount of a scented material and an amount of air such that each of said spherical cells can compress when the object presses against said sheet.

7. The scented bubble wrap of claim 6, wherein the scented material includes a scented fluid.

8. The scented bubble wrap of claim 7, wherein the scented fluid emits a scent chosen from the group of scents consisting of evergreen pine, bayberry, cherry, vanilla, cinnamon and almond.

9. The scented bubble wrap of claim 7 wherein the amount of scented fluid is not less than about 0.01 ounces and not greater than about 0.1 ounces.

10. The scented bubble wrap of claim 6, wherein the sheet is formed of polyethylene.

11. The scented bubble wrap of claim 6, wherein the scented material includes a scented fluid;

wherein the scented fluid emits a scent chosen from the group of scents consisting of evergreen, pine, bayberry, cherry, vanilla, cinnamon and almond;

wherein the amount of scented fluid is not less than about 0.01 ounces and not greater than about 0.1 ounces; and wherein the sheet is formed of polyethylene.

* * * * *